US006617944B2

(12) United States Patent
Latouche et al.

(10) Patent No.: US 6,617,944 B2
(45) Date of Patent: Sep. 9, 2003

(54) INJECTOR DEVICE FOR A MICROWAVE FILTER UNIT USING DIELECTRIC RESONATORS, AND A FILTER UNIT INCLUDING THE DEVICE

(75) Inventors: Yannick Latouche, Toulouse (FR); Serge Vigneron, Auterive (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/053,655

(22) Filed: Jan. 24, 2002

(65) Prior Publication Data

US 2002/0110646 A1 Aug. 15, 2002

(30) Foreign Application Priority Data

Feb. 15, 2001 (FR) ..... 01 02076

(51) Int. Cl.[7] ..... H01P 1/208; H01P 5/12
(52) U.S. Cl. ..... 333/212; 333/135
(58) Field of Search ..... 333/202, 208–212, 333/230, 219.1, 26, 135

(56) References Cited

U.S. PATENT DOCUMENTS 4,614,920 A * 9/1986 Tong ..... 333/135
4,721,933 A * 1/1988 Schwartz et al. ..... 333/212
4,760,361 A * 7/1988 Kobayashi ..... 333/209
5,184,098 A * 2/1993 Kich et al. ..... 333/208
5,804,534 A 9/1998 Zaki
5,880,650 A * 3/1999 Latouche et al. ..... 333/202
6,081,173 A * 6/2000 Sonoda et al. ..... 333/202

FOREIGN PATENT DOCUMENTS

EP 0 615 303 A1 9/1994
EP 0 742 603 A1 11/1996

OTHER PUBLICATIONS

Yu.M. Bexborodov et al.: "Microwave Filters Using Cross–Shaped Dielectric Resonators", Telecommunications & Radio Engineering, Apr. 1985, p. 121, vol. 39/40, No. 4, Silver Spring, Maryland, US.
Kapilevich B Y et al.: "A Compact Microwave Filter Based on a Three–Mode Cutoff Waveguide–Dielectric Cavity", Telecommunications and Radio Engineering Begell House, Inc., Sep. 1, 1987, pp. 97–100, vol. 41/42, No. 9, New York, NY.

* cited by examiner

*Primary Examiner*—Seungsook Ham
(74) *Attorney, Agent, or Firm*—Sughrue Mion, PLLC

(57) ABSTRACT

An injector device for microwave filter units made up of channel filters (1", 1"') provided with cavities housing dielectric resonators. Each filter has an input cavity which receives a signal transmitted by a coaxial cable terminating at a connector (15", 15"') mounted through a wall closing the cavity at an input end of the filter. The injector device of a filter acts electrically on a dielectric resonator accommodated in the input cavity via a probe (16) consisting of a L-shaped rod having a first portion connected to the core of the coaxial cable to extend it into the cavity and a second portion acting on a dielectric element (13) of the resonator via electrical coupling means. The invention also relates to filter units equipped with such injector devices.

14 Claims, 1 Drawing Sheet

INJECTOR DEVICE FOR A MICROWAVE FILTER UNIT USING DIELECTRIC RESONATORS, AND A FILTER UNIT INCLUDING THE DEVICE

The invention relates to an injector device for a microwave filter unit that uses dielectric resonators, in particular a filter unit that includes channel filters whose outputs are combined by a common waveguide or manifold to multiplex them. It also relates to filter units, for example the kind of filter unit referred to above, that incorporate injector devices according to the invention.

BACKGROUND OF THE INVENTION

Filter units of the kind referred to above are used in particular in the field of radio telecommunication systems and especially in equipment that is to be installed onboard satellites. This is known in the art.

One prior art solution for injecting energy into a multipole microwave filter unit is shown diagrammatically in FIG. 1, which represents an output multiplexer unit (OMUX). The output multiplexer unit includes two input channel filters with multiplexed outputs. Each channel filter includes two resonant cavities 1A, 1B or 1'A, 1'B whose modes are coupled by coupling irises. The cavity walls are made of conductive materials and are generally cylindrical or rectangular in shape.

Each channel filter receives a signal transmitted to it by a coaxial cable, for example the cable 2. The cable is connected to an input connector 3 or 3' which injects the transmitted signal into a first cavity of the channel filter including the connector, for example the cavity 1A.

The signal received by a channel filter is filtered in the two cavities of the channel filter, which are equipped with appropriate resonator elements, not shown, as explained later. The signal filtered by a channel filter is transmitted from the second cavity of the channel filter, for example the cavity 5B, to a common waveguide 5 which constitutes the output element of the filter unit, in which the output signals of the channel filters are multiplexed. The second cavity of each channel filter is connected to the waveguide 5 by an output waveguide element; for example, the cavities 1B, 1B' are connected by the elements 6, 6'. Here the guide element is assumed to be disposed axially along the longitudinal axis of the row of cavities of the channel filter, for example the axis XX' in the case of the channel filter 1. The positions of the output waveguide elements 6, 6' and the input connectors 3, 3' of a filter unit of the above kind of depend on the number of poles. This is known in the art.

In the four-pole filter unit shown the cavities are dual mode cavities and incorporate flat dielectric resonator elements perpendicular to a longitudinal axis common to the cavities of the channel filter accommodating them. The input connector of a channel filter is disposed as shown. This is not very satisfactory because it requires a relatively large space L between the channel filters to enable a coaxial cable to be connected to an input connector if the latter is between the respective two channel filters, like the coaxial cable connected to the connector 3 between the channel filters 1 and 1'.

In some cases it is preferable to use a six-pole filter unit to exploit the fact that the injection axes in the channel filters of the unit are then perpendicular to those of the connectors shown in FIG. 1, i.e. perpendicular to the plane of the figure rather than in it, as shown in the case of a four-pole filter unit. It is then possible to leave a much smaller space between the channel filters. However, even though they have the overall size drawback referred to above, filter units with four or five poles constitute a better response to the current specifications than six-pole filter units, which has led to attempts to produce an injector device that is not directly dependent on the number of poles.

European Patent Application EP-A-6961338 describes the bandpass filter unit shown in FIG. 2, which uses dielectric resonators and has input and output connectors 7 for coaxial cables disposed axially along the longitudinal axis YY' of the row of cavities of the filter unit. The rectangular parallelepiped-shaped cavities are formed inside a metal housing 8 and each contains a dielectric resonator in the form of a thick disk, for example the resonator 9. Each disk is in a cavity and parallel to the bottom of the housing, and two adjacent cavities communicate with each other via a window formed in the wall between them, for example the window 10 in the wall 11. Microwave signals are injected and extracted through the two connectors 7, each of which is mounted in a respective one of the two walls that close the ends of the filter unit; each connector either injects a signal into a cavity of the filter unit at which it terminates or extracts a signal therefrom. Injection is effected through a magnetic coupling loop 12 connecting the conductive core of the injection coaxial connector to the ground to which the housing is itself connected. The use of this kind of magnetic coupling loop is disadvantageous in an industrial context because it is difficult to manufacture and is not readily reproducible in the context of mass production. Also, it applies only to filter units with monomode cavities.

SUMMARY OF THE INVENTION

The invention therefore proposes a channel filter injector device for a microwave filter unit using dielectric resonators including a plurality of channel filters with communicating dual mode cavities. Each channel filter includes a filter input cavity receiving a signal to be processed that is transmitted by a coaxial cable via a connector mounted through a wall closing said cavity at an entry end of the filter.

According to one feature of the invention, the injector device provided for a channel filter acts electrically on a resonator dielectric element housed in the input cavity via a probe consisting of a L-shaped rod having a first portion connected to the core of the coaxial cable to extend it into the cavity and a second portion which acts on said resonator dielectric element via electrical coupling means.

In one embodiment of the invention the probe acts on a flat resonator dielectric element perpendicular to a central axis of the input cavity accommodating it, said axis coinciding with the longitudinal axis of the channel filter of which said input cavity is part. The L-shaped rod of the probe has a first portion perpendicular to the plane that said resonator dielectric element defines and by which said element can be electrically excited and a second portion parallel to the plane defined by said resonator dielectric element and in the vicinity of said element in the input cavity accommodating them.

In a preferred embodiment of the invention the second part of a probe is disposed radially relative to the central axis of the input cavity accommodating it, in a direction that corresponds to that in which the resonator dielectric element close to it in said input cavity and on which it acts can be electrically excited.

The invention also proposes a microwave filter unit of the kind defined hereinabove including an injector device of the kind defined hereinabove for each channel filter.

According to the invention the filter unit can include at least one injector device having a probe whose second portion is disposed along a diagonal of a nearby flat resonator dielectric element which is at least approximately in the shape of a parallelogram whose corners are short-circuited together, at least at microwave frequencies, by the conductive wall of the input cavity accommodating said probe and said resonator element.

BRIEF DESCRIPTION OF THE DRAWINGS

The invention, its features and its advantages are explained in the following description, which is given with reference to the figures listed below.

DETAILED DESCRIPTION OF THE DRAWINGS

Figure 1:
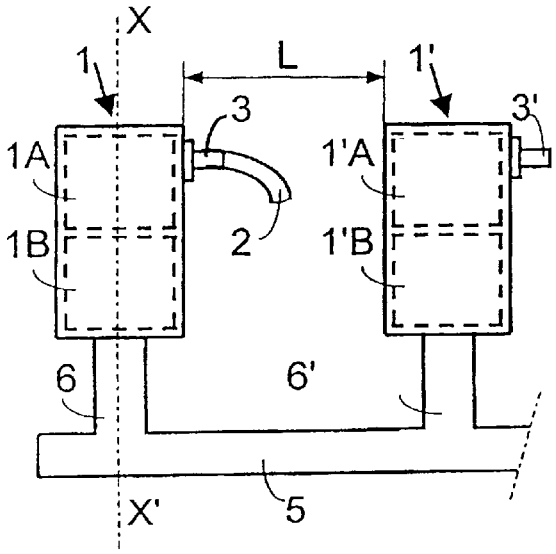
FIG. 1 PRIOR ART
FIG. 1 shows to a prior art output multiplexer filter unit which includes two channel filters.
Figure 2:
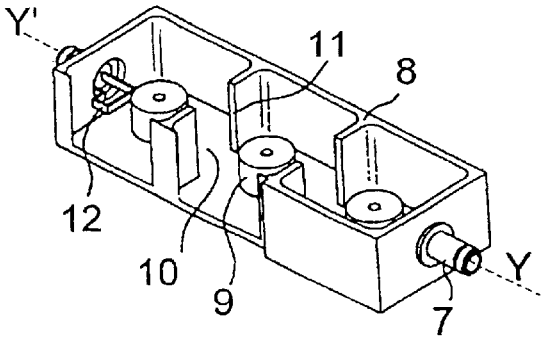
FIG. 2 PRIOR ART
FIG. 2 shows a prior art filter unit with dielectric resonators.
Figure 3:
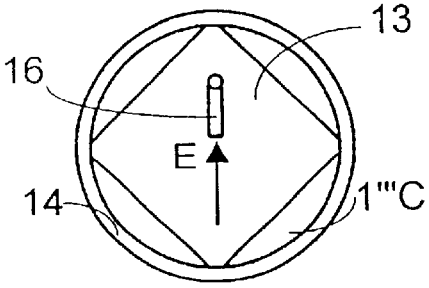
FIG. 3 is a view in cross-section of one embodiment of a filter unit injector device in accordance with the invention.
Figure 4:
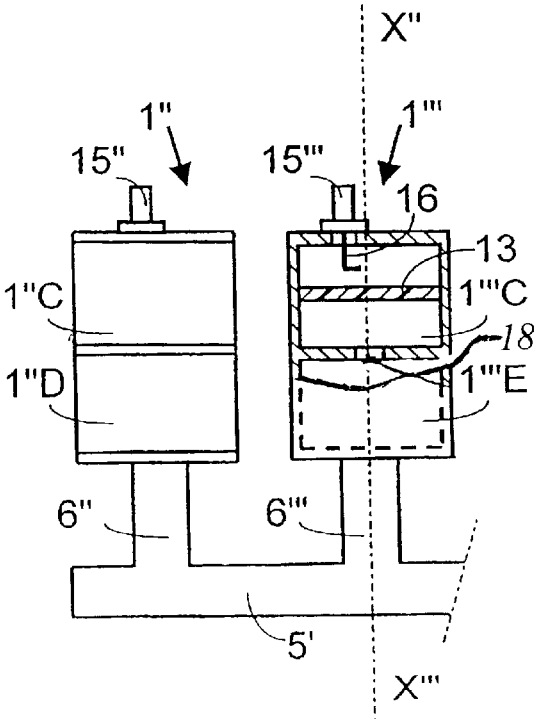
FIG. 4 is a part-sectional view of an embodiment of an output multiplexer filter unit in accordance with the invention with dielectric resonators, one channel filter of which is shown partly in section.

The output multiplexer filter unit shown by way of non-limiting example in FIG. 4 includes two channel filters 1" and 1"' each having dual mode resonant cavities, for example cavities 1C", 1D" or 1C"', 1D"'. The cavities are made from a conductive material and are of cylindrical or rectangular parallelepiped shape. They are aligned along a common axis, such as the X axis X" X"' for the cavities 1C"', 1D"' of the channel filter 1"'. Each of the cavities shown contains a dielectric resonator such as the resonator 13 of the cavities 1"'C in FIGS. 3 and 4.

The dielectric resonator is of the type described in French Patent 2734804, for example.

FIG. 3 shows a flat dielectric resonator element 13. It is approximately the shape of a parallelogram whose four corners are short-circuited together, at least at microwave frequencies, by the conductive wall 14 of the cavity in which it is situated.

In one embodiment a resonator is made up of two flat, parallel and closely spaced resonator elements, as referred to above, in the middle area of the same cavity, and transverse to the central axis of the cavity. The axis X"X"' of the channel filter 1"' corresponds to an axis of this kind for the cavity 1"'C. This produces a bandwidth that cannot easily be obtained with a single resonator element.

Frequency tuning means and coupling means, in particular of the rod or screw type, are inserted between the resonator elements.

Each channel filter includes a first cavity (input cavity) which receives a microwave signal transmitted by a coaxial cable, not shown in FIGS. 3 and 4. The coaxial cable is terminated in a manner that is known in the art at a connector passing through the wall that closes the first cavity at the entry end of the filter, here the connectors 15" and 15"' for the channel filters 1" and 1"'.

The signal received at an input cavity is filtered as it crosses the cavities of the channel filter, which are preferably aligned and communicate with each other in a manner that is known in the art, as shown diagrammatically in FIG. 4 by an iris 18 between cavities 1"'C and 1"'E of the channel filter 1"'.

In accordance with the invention, microwave signals are injected into the input cavities of the channel filters by electrical coupling means. To this end, the input cavities are equipped with injector probes each of which is associated with a respective connector, for example the probe 16 and the connector 15"' in FIG. 4.

Each probe is positioned to excite the resonator housed in the cavity into which it penetrates, for example the resonator in the cavity 1"'C in the case of the probe 16 shown in FIGS. 3 and 4.

In a preferred embodiment, a probe, for example the probe 16, consists of an at least approximately L-shaped rod, a first portion of which is connected directly or indirectly to the core of a coaxial cable to extend it into the cavity, to which that cable is connected by a connector, for example the connector 15"' for the input cavity 1"'C. The second part of the L-shape of the probe 16 provides electrical coupling to the dielectric resonator element near it in the cavity accommodating them both.

If the resonator accommodated in an input cavity includes a flat resonator dielectric element responsive to an excitation electric field E, as shown diagrammatically in FIG. 3, the probe 16 preferably consists of a L-shaped rod with a first portion perpendicular to the field E and to the plane of the resonator. The second portion of the L-shaped probe is then parallel to the field and therefore to the resonator plane.

As indicated above, the first portion of a probe rod 16 is connected either directly to the end of the core of the coaxial cable which transmits the signal to be processed to it or to an end of a portion of the connector, for example the connector 15"' at which said cable core terminates. If the resonator dielectric element is flat, the connection is made in a manner known to the person skilled in the art so that the first portion of the probe rod 16 is perpendicular to the plane of the resonator element when the injector device including it is fitted. In principle, it is possible to limit a probe of an injector device according to the invention to the first portion described above if the dimensions and the manner of mounting the probe are chosen so that an end of the first portion is located in the immediate vicinity of the flat resonator dielectric element, or the nearest flat resonator dielectric element of the resonator, on which the probe is to act. It is nevertheless preferable for an injector device probe to have a second portion perpendicular to the first portion so that it is parallel to the direction in which the flat dielectric element(s) referred to above are flat.

This avoids a too narrow and consequently electrically undesirable spacing between the probe and the nearest part of the resonator element.

The orientation of the second portion of a probe, as envisaged above, conditions the orientation of the electric field acting on the resonator to which the second part extends. If the resonator dielectric element is flat and perpendicular to the central axis of the input cavity, the second probe portion is radially disposed relative to axis of said cavity, for example.

In the case of the parallelepiped-shaped flat resonator dielectric element envisaged above, this leads to orienting the second probe portion along one of the diagonals of the parallelogram formed by the resonator flat element in whose vicinity it is placed and on which it acts directly; this orientation is shown diagrammatically in FIG. 3.

The magnitude of the coupling achieved depends on the length chosen for the second probe portion, which makes it possible to choose the required coupling at the level of a particular input cavity accurately.

The length of the probe, to be more precise the length of the first portion of the probe, is chosen as a function of the required bandwidth, which increases as the length of the probe increases. This facilitates the production of similar filter units with different bandwidths.

The injector device according to the invention is of course applicable to filter units including a number of poles other than four. It is especially advantageous for filter units with four or five poles having channel filters whose outputs are multiplexed, because it significantly reduces the overall dimensions of the filter unit, in addition to the advantages referred to above with regard to the injector device itself.

What is claimed is:

1. A channel filter injector device for a microwave filter unit using dielectric resonators and including a plurality of channel filters with communicating dual mode cavities, each channel filter including a filter input cavity receiving a signal to be processed transmitted by a coaxial cable via a connector mounted through a wall closing said input cavity at an entry end of the filter, characterized in that the signal acts electrically on a resonator dielectric element housed in said input cavity via a probe consisting of a L-shaped rod having a first portion connected to the core of the coaxial cable, the first portion extending into said input cavity, and a second portion which acts on said resonator dielectric element via electrical coupling means.

2. The injector device according to claim 1, wherein the probe acts on a flat resonator dielectric element perpendicular to a central axis of the input cavity accommodating the flat resonator dielectric element, said axis coinciding with the longitudinal axis of the channel filter of which said input cavity is part, the L-shaped rod of the probe having a first portion perpendicular to the plane that said resonator dielectric element defines and by which said element can be electrically excited and a second portion parallel to the plane defined by said resonator dielectric element and in the vicinity of said element in the input cavity accommodating the first portion and the second portion.

3. The injector device according to claim 2, wherein said second portion of the L-shaped rod is disposed radially relative to the central axis of the input cavity accommodating the L-shaped rod, in a direction that corresponds to that in which the resonator dielectric element close to the L-shaped rod in said input cavity and on which it acts can be electrically excited.

4. A microwave filter unit including a plurality of channel filters with communicating dual mode cavities that contain dielectric filters, each channel filter including a filter input cavity receiving a signal to be processed transmitted by a coaxial cable via an input connector mounted through a wall closing said filter input cavity at an input end of the filter, wherein the microwave filter comprises an injector device associated with said filter input cavity of each channel filter and acting through electrical coupling means on a resonator dielectric member housed in said filter input cavity via a probe consisting of a L-shaped rod having a first portion connected to the core of the coaxial cable to extend it into said filter input cavity and a second portion that acts on said resonator dielectric element via coupling means.

5. The microwave filter unit according to claim 4, wherein the probe of an input cavity of a channel filter acts on a flat resonator dielectric element perpendicular to a central axis of the input cavity accommodating the resonator, the axis coinciding with the longitudinal axis of the channel filter of which said input cavity is part and the L-shaped rod of the probe has a first portion perpendicular to the plane that said resonator dielectric element defines and by which said element can be electrically excited and a second portion parallel to the plane defined by said resonator dielectric element and near said resonator dielectric element in the input cavity accommodating the first portion and second portion of the L-shaped rod.

6. The microwave filter unit according to claim 5, wherein said second portion of a probe is radially disposed relative to the central axis of the cavity accommodating the probe, in a direction that corresponds to that in which the plane resonator dielectric element close to said second portion of the probe in the cavity accommodating the first portion and the second portion of the probe, can be electrically excited.

7. The filter unit according to claim 6, wherein the second portion of a probe is disposed along a diagonal of a nearby flat resonator dielectric element which is at least approximately in the shape of a parallelogram whose corners are short-circuited together, at least at microwave frequencies, by the conductive wall of the input cavity accommodating said probe and said resonator element.

8. The device of claim 1, wherein at least one end of said second portion is not connected to a wall of the input cavity.

9. The microwave filter unit of claim 4, wherein at least one end of said second portion is not connected to a wall of the filter input cavity.

10. The device of claim 1, wherein the L-shaped rod only has two segments which are perpendicular to each other.

11. The microwave filter unit of claim 4, wherein the L-shaped rod only has two segments which are perpendicular to each other.

12. The device of claim 1, wherein at least one of said plurality of channel filters comprises at least two cavities and at least one of said at least two cavities is arranged in a vertical direction with respect to the other said at least two cavities.

13. The microwave filter unit of claim 4, wherein at least one of said plurality of channel filters comprises at least two cavities and at least one of said at least two cavities are arranged in a vertical direction with respect to the other said at least two cavities.

14. The device of claim 1, wherein the first portion of the L-shaped rod is perpendicular to a closest face of the resonator dielectric element.

* * * * *